US010345041B2

(12) United States Patent
Oota et al.

(10) Patent No.: US 10,345,041 B2
(45) Date of Patent: Jul. 9, 2019

(54) METHOD OF DRYING WET PAPER AND WASTE PAPER RECYCLING APPARATUS

(71) Applicant: DUPLO SEIKO CORPORATION, Wakayama (JP)

(72) Inventors: Ryuichi Oota, Wakayama (JP); Yoshihisa Higashimoto, Wakayama (JP); Masato Okuno, Wakayama (JP); Nobuki Tanimoto, Wakayama (JP); Yoshiteru Ishikawa, Wakayama (JP)

(73) Assignee: Duplo Seiko Corporation, Wakayama (JP)

( * ) Notice: Subject to any disclaimer, the term of this patent is extended or adjusted under 35 U.S.C. 154(b) by 183 days.

(21) Appl. No.: 15/465,709

(22) Filed: Mar. 22, 2017

(65) Prior Publication Data

US 2017/0292785 A1 Oct. 12, 2017

(30) Foreign Application Priority Data

Apr. 12, 2016 (JP) ..... 2016-079219

(51) Int. Cl.

| | |
|---|---|
| ***F26B 3/20*** | (2006.01) |
| ***F26B 13/10*** | (2006.01) |
| ***F26B 13/12*** | (2006.01) |
| ***F26B 13/14*** | (2006.01) |
| ***F26B 13/18*** | (2006.01) |

(52) U.S. Cl.

CPC ..... *F26B 3/20* (2013.01); *F26B 13/105* (2013.01); *F26B 13/12* (2013.01); *F26B 13/14* (2013.01); *F26B 13/18* (2013.01)

(58) Field of Classification Search

CPC ..... F26B 3/20; F26B 12/105; F26B 13/12; F26B 13/14; F26B 13/18; Y02W 30/648

USPC ..... 34/345

See application file for complete search history.

(56) References Cited

U.S. PATENT DOCUMENTS 1,432,729 A * 10/1922 Pinder ..... F26B 3/283 100/304
1,595,240 A * 8/1926 Ogden ..... C23C 14/562 118/50
3,303,576 A * 2/1967 Sisson ..... D21F 5/00 162/207
4,247,990 A * 2/1981 Ohls ..... D21F 5/182 34/115
4,942,675 A * 7/1990 Sundgvist ..... D21F 5/00 34/122
5,966,835 A * 10/1999 Bakalar ..... D21F 5/002 34/119

(Continued)

FOREIGN PATENT DOCUMENTS

JP WO 2007013416 A1 * 2/2007 ..... D06M 15/693
JP 2012-140738 7/2012
JP 2017190534 A * 10/2017 ..... F26B 3/20

OTHER PUBLICATIONS

English language machine translation of JP 2012-140738.

*Primary Examiner* — Stephen M Gravini
(74) *Attorney, Agent, or Firm* — Fildes & Outland, P.C.

(57) ABSTRACT

In a press area, a wet paper is pressed against a heating surface to heat the wet paper with a conveying surface to conveying the wet paper to form a pressure regulating gap between the heating surface and the conveying surface. The pressure regulating gap is provided in a size less than a thickness of the wet paper and more than a thickness of recycled paper to be produced therefrom.

11 Claims, 9 Drawing Sheets

(56) References Cited

U.S. PATENT DOCUMENTS 6,308,436 B1 * 10/2001 Stipp ..... D21F 5/006 34/422
6,314,659 B1 * 11/2001 Parker ..... D21F 1/30 34/114
6,581,301 B1 * 6/2003 Thorp ..... D21F 5/182 34/114
6,694,639 B2 * 2/2004 Hanaya ..... D21F 5/18 34/114
6,701,637 B2 * 3/2004 Lindsay ..... D21F 5/004 162/206
6,964,117 B2 * 11/2005 Parent ..... F26B 13/16 34/115
7,024,800 B2 * 4/2006 Gorbell et al. ..... F26B 19/005 34/576
7,073,274 B2 * 7/2006 Yoshida ..... F26B 13/103 101/424.1
7,225,558 B2 * 6/2007 Hagen ..... D21F 5/182 34/124
7,325,331 B2 * 2/2008 Luukkanen ..... D21F 5/18 34/446
7,334,347 B2 * 2/2008 Mann ..... C04B 18/241 162/55
7,681,328 B2 * 3/2010 DuVal ..... C11D 3/50 34/597
7,690,131 B2 * 4/2010 Mausser ..... D21F 5/021 162/358.1
7,716,850 B2 * 5/2010 Deem ..... D21F 5/181 162/359.1
7,918,040 B2 * 4/2011 Lenoir ..... D21F 5/00 162/359.1
8,756,830 B2 * 6/2014 Priebe ..... B41J 11/002 118/239
8,904,668 B2 * 12/2014 Priebe ..... F26B 3/22 101/450.1
2017/0183816 A1 * 6/2017 Terai ..... D21B 1/32
2017/0292785 A1 * 10/2017 Oota ..... F26B 3/20
2018/0065289 A1 * 3/2018 Ichinomiya ..... B29C 47/0021

* cited by examiner

METHOD OF DRYING WET PAPER AND WASTE PAPER RECYCLING APPARATUS

FIELD OF THE INVENTION

The present invention relates to a waste paper recycling apparatus capable of recycling paper by being installed in an office and the like, where waste paper is generated, and specifically relates to a technique to dry a wet paper.

BACKGROUND OF THE INVENTION

Conventional waste paper recycling apparatuses include, for example, the one disclosed in JP 2012-140738A. This is configured as illustrated in FIG. 14.

In FIG. 14, a papermaking unit 13 produces a wet paper 12 from a pulp suspension and has a papermaking wire 43 and a head box 44. The papermaking wire 43 is composed of a mesh belt stretched over a plurality of rollers 42 to move in a conveying direction of the wet paper 12. The head box 44 pours the pulp suspension onto the papermaking wire 43.

The wet paper 12 is dewatered by a dewatering unit 20, which is composed of a felt water absorption belt 47 stretched over a plurality of rollers 46. In the dewatering unit 20, the wet paper 12 is transferred from the papermaking wire 43 to the water absorption belt 47 and the water absorption belt 47 dewaters the wet paper 12 by absorption.

The dewatered wet paper 12 is dried by a drier 14, which has a first conveying belt 51 and a second conveying belt 53. The first conveying belt 51 is a metal belt stretched over a drying roller 49 with built-in heating devices 48 and a plurality of rollers 50. The second conveying belt 53 is a resin mesh belt stretched over a plurality of rollers 52.

In the drier 14, the first conveying belt 51 and the second conveying belt 53 overlap each other across the wet paper 12 on an outer peripheral surface of the drying roller 49 and the drying roller 49 dries the wet paper 12 by heating via the first conveying belt 51.

The wet paper 12 is press dewatered via the water absorption belt 47 and the first conveying belt 51 by a pair of pressing rollers 46*a* and 50*a*, which also transfer the wet paper 12 from the water absorption belt 47 to the first conveying belt 51.

The wet paper 12 is dried to produce dry paper 61, which is released from the first conveying belt 51 by a scraper 111 at an outward terminal position of the first conveying belt 51 to be guided to a finishing unit 15.

The finishing unit 15 applies finishing process to the dry paper 61 and delivers recycled paper 62 obtained from the finishing process to a paper holder 63. The finishing unit 15 is provided with a cutting device 60 made of metal to cut the dry paper 61 in a predetermined size and a slitting device 112.

In the above configuration, the pair of pressing rollers 46*a* and 50*a* press the water absorption belt 47 and the first conveying belt 51 for dewatering and transfer at the same time. The wet paper 12 sandwiched between the water absorption belt 47 and the first conveying belt 51 is then transferred from the water absorption belt 47 to the first conveying belt 51. After that, at a position away from the position for transferring the wet paper 12, the wet paper 12 is dried by indirect heating with the drying roller 49 having the built-in heating devices 48 via the first conveying belt 51.

Here, compared with a heating temperature for drying that is set for the drying roller 49, the temperature of the first conveying belt 51 at the position for transferring the wet paper 12 is low. The temperature of the wet paper 12 is then raised to the heating temperature for drying after the transfer to the first conveying belt 51.

Accordingly, the wet paper 12 has no concern for sticking to the first conveying belt 51 even when the pair of pressing rollers 46*a* and 50*a* strongly press the water absorption belt 47 and the first conveying belt 51.

A large space is however required to secure the paths for the water absorption belt 47 and the first conveying belt 51, interfering with downsizing of the waste paper recycling apparatus.

Meanwhile, when the wet paper 12 is rapidly heated, that is, the wet paper 12 is strongly pressed directly on the heating surface at high temperature of the drying roller 49, the water in the wet paper 12 rapidly vaporizes and expands in a fibrous layer of the wet paper 12 until coming out of the fibrous layer of the wet paper 12, and the thus generated bubbles disturbs the fibrous layer of the wet paper 12, in particular the surface layer of the fibrous layer. As a result, the strength of the dried paper decreases, causing sticking of a thin paper layer to the heating surface.

The present invention has made to solve the above problems, and it is an object thereof to provide a method of drying a wet paper and a waste paper recycling apparatus that achieve downsizing of the apparatus while being capable of drying a wet paper without sticking.

DISCLOSURE OF THE INVENTION

To solve the above problems, a method of drying a wet paper of the present invention includes: moving a heating surface to heat the wet paper with a drying setting temperature for the wet paper in a conveying direction of the wet paper; pressing the wet paper against the heating surface in a press area by a conveying surface to convey the wet paper; and drying the wet paper on the heating surface to make recycled paper, wherein a pressure regulating gap, formed in the press area, between the heating surface and the conveying surface is provided in a size less than a thickness of the wet paper and more than a thickness of the recycled paper, thereby regulating a pressure applied in the press area to a target pressure to obtain dry paper without burning on the heating surface.

A waste paper recycling apparatus of the present invention, includes: a conveyor to convey a wet paper, the conveyor having a conveying surface to convey the wet paper; a drier to dry the wet paper on a heating surface with a drying setting temperature for the wet paper, the heating surface moving in a conveying direction of the wet paper; a press area to press the wet paper against the heating surface by the conveying surface; and a pressure regulator to regulate a pressure applied in the press area, wherein the press area has a pressure regulating gap between the heating surface and the conveying surface, and the pressure regulator to regulate the pressure applied in the press area to a target pressure by providing the pressure regulating gap in a size less than a thickness of the wet paper and more than a thickness of recycled paper.

The waste paper recycling apparatus of the present invention preferably further includes a press dewatering unit to press dewater the wet paper upstream from the press area in the conveying direction.

In the waste paper recycling apparatus of the present invention, the drier preferably has: one drying rotary element with an outer peripheral surface as the heating surface; and a heating device to warm the heating surface to the drying setting temperature for the wet paper, and the conveyor preferably includes: a first conveying rotary element with a first outer peripheral surface as a part of the conveying surface, the first conveying rotary element disposed to be stretched over a plurality of supporting rollers in an endless path; and a second conveying rotary element with a second outer peripheral surface as another part of the conveying surface, the second conveying rotary element disposed around the heating surface of the drying rotary element to be stretched over a plurality of supporting rollers and the drying rotary element in an endless path.

In the waste paper recycling apparatus of the present invention, the drier preferably has: a drying rotary element with an outer peripheral surface as the heating surface, the drying rotary element disposed to be stretched over a plurality of supporting rollers in an endless path; and a heating device to warm the heating surface to the drying setting temperature for the wet paper, and the conveyor preferably includes: a first conveying rotary element with a first outer peripheral surface as a part of the conveying surface, the first conveying rotary element disposed to be stretched over a plurality of supporting rollers in an endless path; and a second conveying rotary element with a second outer peripheral surface as another part of the conveying surface, the second conveying rotary element disposed around the heating surface of the drying rotary element to be stretched over a plurality of supporting rollers and the drying rotary element in an endless path.

In the waste paper recycling apparatus of the present invention, the pressure regulator preferably includes a tension regulator to regulate tension of the second conveying rotary element, the tension regulator regulating the tension to increase or decrease the pressure regulating gap, thereby bringing the pressure applied in the press area to the target pressure.

In the waste paper recycling apparatus of the present invention, the pressure regulator preferably includes a roller position regulator to regulate a position of a particular supporting roller of the first conveying rotary element, the roller position regulator regulating the position of the particular supporting roller to increase or decrease the pressure regulating gap, thereby bringing the pressure applied in the press area to the target pressure.

In the waste paper recycling apparatus of the present invention, the pressure regulator preferably includes a roller position regulator to regulate a position of a particular supporting roller of the second conveying rotary element, the roller position regulator regulating the position of the particular supporting roller to increase or decrease the pressure regulating gap, thereby bringing the pressure applied in the press area to the target pressure.

Effects of the Invention

According to the present invention described above, the pressure regulating gap between the heating surface and the conveying surface is provided in a size less than the thickness of the wet paper and more than the thickness of the recycled paper, thereby regulating the pressure applied in the press area to a target pressure that does not excessively compress the fibrous layer of the wet paper.

As a result, at an appropriate target pressure not to give an excessive pressing force to the wet paper, the wet paper is pressed against the heating surface, thereby preventing burning of the wet paper on the heating surface.

That is, the fibrous layer of the wet paper is not excessively compressed while being pressed against the heating surface, and thus the water in the wet paper vaporized by heating immediately comes out of the fibrous layer of the wet paper without being inhibited by the fibrous layer.

As just described, even when the water in the wet paper rapidly vaporizes and expands in the fibrous layer of the wet paper by directly heating the wet paper on the heating surface, the vaporized water in the wet paper immediately comes out of the fibrous layer of the wet paper to prevent disturbance of the fibrous layer of the wet paper, in particular the surface layer of the fibrous layer.

Accordingly, when the wet paper is dried on the heating surface, the strength of the paper produced therefrom is not reduced, thereby preventing sticking of a thin paper layer to the heating surface.

DESCRIPTION OF THE EMBODIMENTS

First Embodiment

Figure 13:
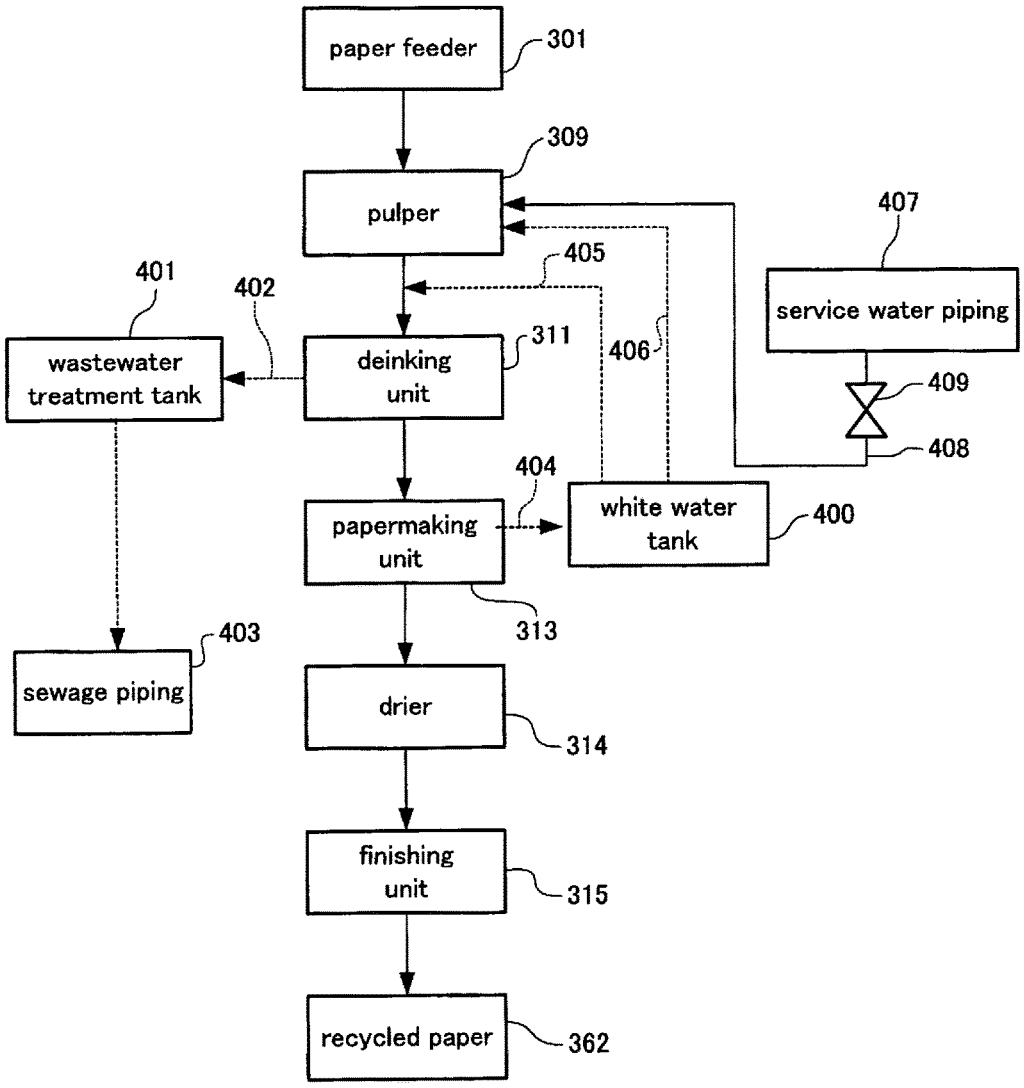
FIG. 13 is a block diagram illustrating the waste paper recycling apparatus of the present invention.
Figure 14:
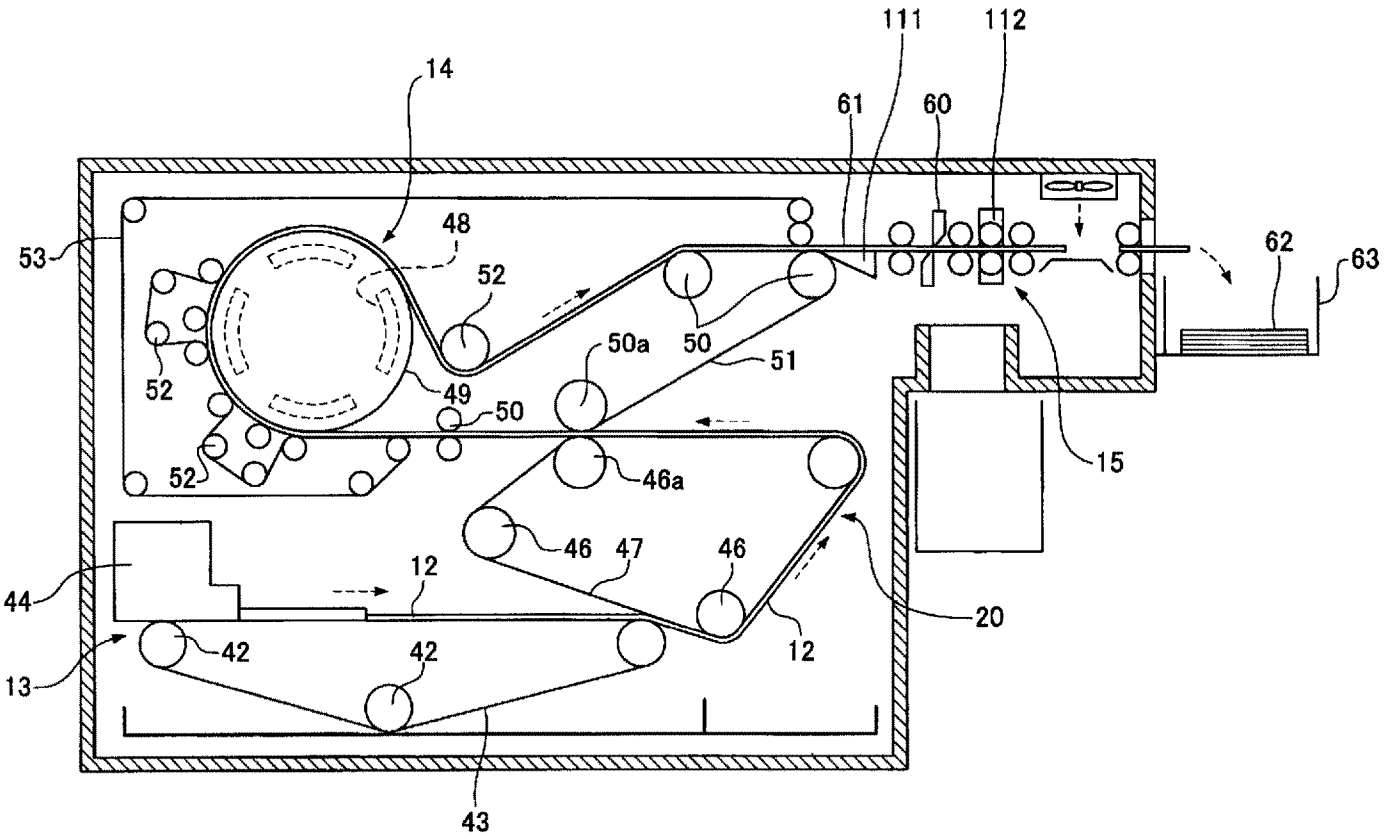
FIG. 14 (prior art)
FIG. 14 is a schematic diagram illustrating a conventional waste paper recycling apparatus.

The following will describe the first embodiment of the present invention in accordance with the accompanying drawings. As illustrated in FIG. 13, a waste paper recycling apparatus has a plurality of processing units configuring a waste paper recycling system. The processing units includes a paper feeder 301, a pulper 309, a deinking unit 311, a papermaking unit 313, a drier 314, a finishing unit 315, a white water tank 400, and a wastewater treatment tank 401.

The paper feeder 301 is to charge the pulper 309 with waste paper as a recycle material. The pulper 309 defiberizes waste paper to produce a pulp suspension containing recycled pulp. The deinking unit 311 deinks the pulp suspension to prepare deinked pulp.

Figure 1:
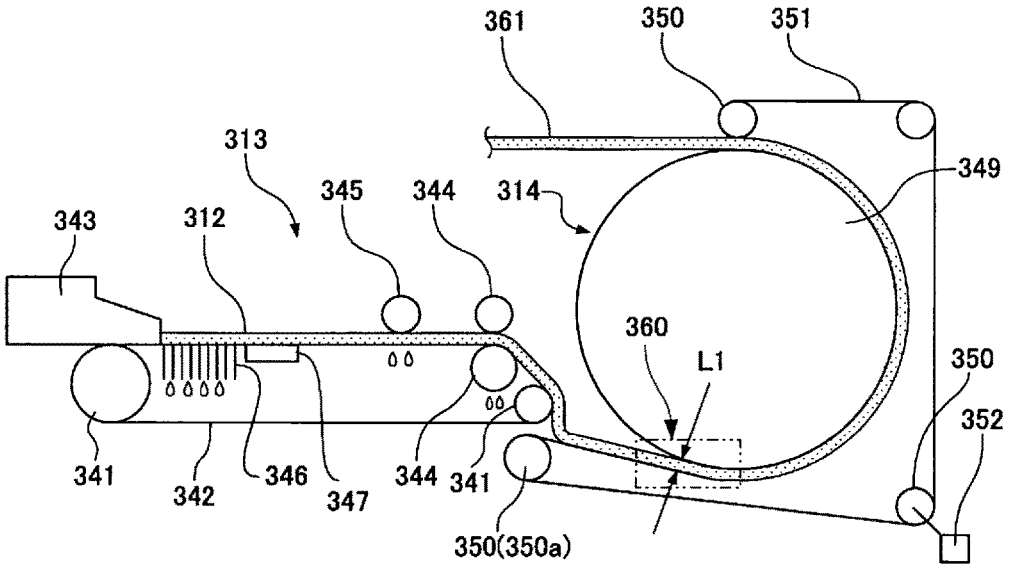
FIG. 1 is a schematic diagram illustrating a major portion of a waste paper recycling apparatus in an embodiment of the present invention.

As illustrated in FIG. 1, the papermaking unit 313 produces a wet paper 312 from the pulp suspension and has a papermaking wire 342 and a head box 343. The papermaking wire 342 is composed of a mesh belt stretched over a plurality of supporting rollers 341. The head box 343 pours the pulp suspension onto the papermaking wire 342.

The papermaking wire 342 in an endless path serves as a first conveying rotary element of a conveyor to convey the wet paper 312. The papermaking wire 342 has an outer peripheral surface as a conveying surface for the wet paper 312. The papermaking wire 342 is in a running path composed of an outward portion from the head box 343 to near a drying roller 349 described later and a returning portion from the drying roller 349 back to the head box 343.

The outward portion of the papermaking wire 342 is provided with a drainer 346, a suction device 347, a pair of pressing rollers 344, and a dewatering roller 345.

The drainer 346 is located near the head box 343 below the papermaking wire 342. By sliding contact with the lower surface of the papermaking wire 342, the drainer 346 conducts water from the lower surface of the papermaking wire 342 downward. The suction device 347 sucks water from the wet paper 312 via the papermaking wire 342. The pair of pressing rollers 344 faces each other across the papermaking wire 342 to serve as a press dewatering unit. The dewatering roller 345 is disposed on a surface of the path of the papermaking wire 342.

The drier 314 has a drying roller 349 for drying the dewatered wet paper 312. The drying roller 349 is composed of one roller as a drying rotary element with a built-in heating device and has an outer peripheral surface as a heating surface for the wet paper 312. The heating surface is heated at a drying setting temperature for the wet paper 312 by the heating device and moves in a direction to convey the wet paper 312 with the rotation of the drying roller 349.

A canvas belt 351 as a second conveying rotary element of the conveyor is disposed around the outer peripheral surface of the drying roller 349 to be stretched over the drying roller 349 and a plurality of supporting rollers 350 in an endless path. One of the supporting rollers 350 is coupled to a tension regulator 352 to regulate tension of the canvas belt 351, where the tension regulator 352 serves as a pressure regulator.

In the canvas belt 351, part of the conveying surface to convey the wet paper 312 covers part of the heating surface of the drying roller 349. During the drying in the drier 314, the wet paper 312 is sandwiched between the canvas belt 351 and the outer peripheral surface of the drying roller 349, and the conveying surface and the heating surface move together. During the drying, the drying roller 349 directly dries the wet paper 312 on the heating surface.

The area where the conveying surface of the canvas belt 351 and the heating surface of the drying roller 349 face each other first in the drying serves as a press area 360. In the press area 360, the canvas belt 351 presses the wet paper 312 at a target pressure against the heating surface with the conveying surface.

Between a particular supporting roller 350*a* upstream from the press area 360 in the conveying direction and the drying roller 349, the canvas belt 351 forms an introduction section. The canvas belt 351 in the introduction section extends in a tangential direction of the outer peripheral surface of the drying roller 349.

On the conveying surface of the canvas belt 351 in the introduction section, the wet paper 312 is supplied from the papermaking wire 342.

The details are described in the following. In the introduction section of the canvas belt 351, part of the running path of the canvas belt 351 is in a vertical positional relationship with the running path of the papermaking wire 342. Then, at a terminal position of the outward portion in the running path of the papermaking wire 342, the canvas belt 351 runs just below the papermaking wire 342.

The wet paper 312 conveyed by the papermaking wire 342 is released from the papermaking wire 342 when the papermaking wire 342 turns over to the returning portion at the terminal position of the outward portion in the running path of the papermaking wire 342.

The wet paper 312 is continuously released with the running of the papermaking wire 342, moves downward due to its own weight, and is caught by the canvas belt 351.

Then, in the press area 360, a pressure regulating gap L1 is formed between the conveying surface of the canvas belt 351 and the heating surface of the drying roller 349. The position of the pressure regulating gap L1 is at a contact point between the canvas belt 351 and the drying roller 349 when no wet paper 312 exists between the canvas belt 351 and the drying roller 349. The pressure regulating gap L1 is increased or decreased with the regulation of the tension of the canvas belt 351 by the tension regulator 352. In this embodiment, the pressure regulating gap L1 is regulated in a size less than a thickness of the wet paper 312 and more than a thickness of recycled paper produced therefrom. The pressure regulating gap L1 is described more below.

As a result, the pressure applied in the press area 360 is regulated to the target pressure. Then, in an early stage of the drying, the wet paper 312 is pressed against the heating surface at the target pressure that does not excessively compress the fibrous layer of the wet paper 312, thereby preventing burning of the wet paper 312 on the heating surface of the drying roller 349.

The drying efficiency is improved by a longer coverage of the heating surface of the drying roller 349 with the canvas belt 351. The press area 360 is preferably provided at a position described as follows. That is, as illustrated in FIG. 1, when a dry paper 361 is released from the heating surface in an upper position of the drying roller 349, the press area 360 is preferably provided within the lower left quarter of the drying roller 349 in the illustration of FIG. 1. This allows the canvas belt 351 to cover half or more of the drying roller 349. It also facilitates delivery of the wet paper 312 by its own weight.

The wet paper 312 is thus dried to produce the dry paper 361, which is released from the drying roller 349 by a scraper, not shown, at an outward terminal position of the canvas belt 351 to be guided to the finishing unit 315.

The finishing unit 315 applies finishing process to the dry paper 361 obtained by drying the wet paper 312 and is provided with a cutting device made of metal and the like to cut the dry paper 361 and produce the recycled paper 362 in predetermined size.

The wastewater treatment tank 401 treats the deinked liquid waste inflowing from the deinking unit 311 through a deinking drainage system 402. In the tank 401, a filter removes fiber, ink, and toner. The liquid waste is neutralized by adding chemicals as needed and treated to the water quality allowed for drainage to sewage piping 403 of the public sewerage.

The white water tank 400 retains white water, which is wastewater containing recycled pulp inflowing from the papermaking unit 313 through a papermaking drainage system 404. The tank 400 recirculates the white water, through white water recirculation systems 405 and 406, to the respective parts in the waste paper recycling system.

The pulper 309 is connected to water supply piping 108 to supply service water from a source of water supply which is a service water piping 407 in this example. The water supply piping 408 is provided with a main valve device 409 composed of an electromagnetic valve for emergency stop.

Operations of the above configuration are described below. In the waste paper recycling apparatus, the waste paper recycling system is operated in each processing unit of the paper feeder 301, the pulper 309, the deinking unit 311, the papermaking unit 313, the drier 314, the finishing unit 315, the wastewater treatment tank 401, and the white water tank 400.

In the papermaking unit 313, the pulp suspension is poured onto the papermaking wire 342 from the head box 343 to produce the wet paper 312. The wet paper 312 is then dewatered in the drainer 346, the suction device 347, the dewatering roller 345, and the pressing rollers 344 to be conditioned at predetermined water content.

At the outward terminal of the papermaking wire 342, the wet paper 312 is supplied on the conveying surface of the canvas belt 351 in the introduction section.

In the drying in the drier 314, the wet paper 312 moves towards the press area 360 with the movement of the canvas belt 351. In the press area 360, the canvas belt 351 then presses the wet paper 312 at the target pressure against the heating surface with the conveying surface.

The pressure applied in the press area 360 is regulated by increasing or decreasing the pressure regulating gap L1 between the conveying surface of the canvas belt 351 and the heating surface. In this example, the pressure regulating gap L1 is provided in a size less than the thickness of the wet paper 312 and more than the thickness of the recycled paper 362 to regulate the pressure applied in the press area 360 to the target pressure.

For example, after passing through the pressing rollers 344 and not yet reaching the drying roller 349, the wet paper 312 has a thickness of approximately 0.3 mm. The recycled paper 362 as a final product has a thickness of approximately 0.2 mm. Accordingly, the pressure regulating gap L1 can be regulated in a range roughly from 0.3 mm to 0.2 mm, and in this example, 0.2 mm to be ⅔ of the thickness of the wet paper 312. In another example, the gap L1 may be 0.23 mm to be ¾ of the thickness of the wet paper 312.

The drying roller 349 has the heating surface heated at the drying setting temperature for the wet paper 312. To the heating surface, the wet paper 312 is directly transferred. Further, the wet paper 312 is sandwiched between the canvas belt 351 and the outer peripheral surface of the drying roller 349 to move the conveying surface and the heating surface together. During the drying, the drying roller 349 directly dries the wet paper 312 on the heating surface.

At this point, the canvas belt 351 presses the wet paper 312 at the target pressure against the heating surface of the drying roller 349 in an early stage of the drying, thereby preventing burning of the wet paper 312 on the heating surface. Accordingly, the dry paper 361 without burning on the heating surface is obtained.

That is, in an early stage of the drying, to directly transfer the wet paper 312 to the heating surface at high temperature for heating at the setting temperature for the wet paper 312, the pressure applied in the press area 360 is the appropriate target pressure that does not excessively compress the fibrous layer of the wet paper 312, thereby achieving transfer not to give an excessive pressing force to the wet paper 312. As a result, the fibrous layer of the wet paper 312 is not compressed excessively. The water in the heated wet paper 312 thus vaporizes without being inhibited by the fibrous layer and immediately comes out of the fibrous layer of the wet paper 312.

As a result, the direct heating of the wet paper 312 on the heating surface allows, even when the water in the wet paper 312 rapidly vaporizes and expands in the fibrous layer of the wet paper 312, the vaporized water to immediately come out of the fibrous layer, thereby preventing disturbance of the fibrous layer of the wet paper 312, in particular the surface layer of the fibrous layer.

Accordingly, when the wet paper 312 is dried on the heating surface, the strength of the paper is not reduced, thereby preventing sticking of a thin paper layer to the heating surface.

In the present embodiment, an increase or a decrease of the pressure regulating gap L1 is regulated by the tension regulator 352 as the pressure regulator. However, such an increase or a decrease of the pressure regulating gap L1 may be regulated by adjusting the position of the drying roller 349 as the drying rotary element. This may apply in the same manner to other embodiments described below.

Second Embodiment

Figure 2:
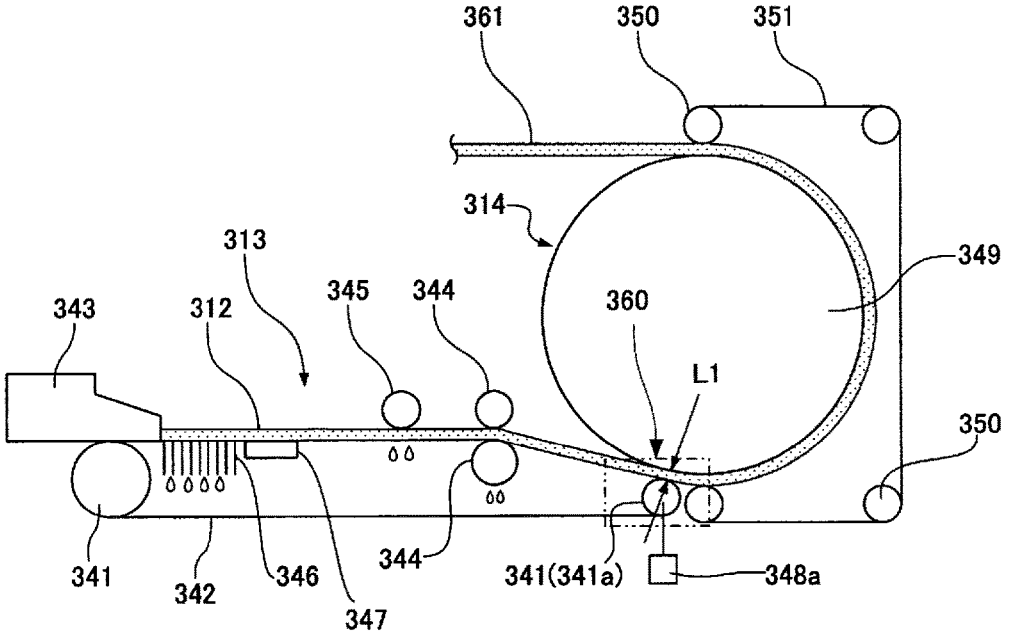
FIG. 2 is a schematic diagram illustrating a major portion of a waste paper recycling apparatus in another embodiment of the present invention.

As illustrated in FIG. 2, the wet paper 312 is transferred from the papermaking wire 342 to the drying roller 349 in the press area 360. In the press area 360, a particular supporting roller 341*a* as one of the supporting rollers 341 supporting the papermaking wire 342 is disposed at a position facing the drying roller 349. The particular supporting roller 341*a* is coupled to a roller position regulator 348*a* as the pressure regulator.

Then, in the press area 360, at a position corresponding to the particular supporting roller 341*a*, the pressure regulating gap L1 is provided as a gap between the conveying surface of the papermaking wire 342 and the heating surface of the drying roller 349, facing each other across the wet paper 312.

In this case, the position of the particular supporting roller 341*a* is regulated by the roller position regulator 348*a* to increase or decrease the pressure regulating gap L1, thereby bringing the pressure applied in the press area 360 to the target pressure.

As a result, in an early stage of the drying, the wet paper 312 is pressed against the heating surface of the drying roller 349 at the target pressure that does not excessively compress the fibrous layer of the wet paper 312, thereby preventing burning of the wet paper 312 on the heating surface.

Third Embodiment

Figure 3:
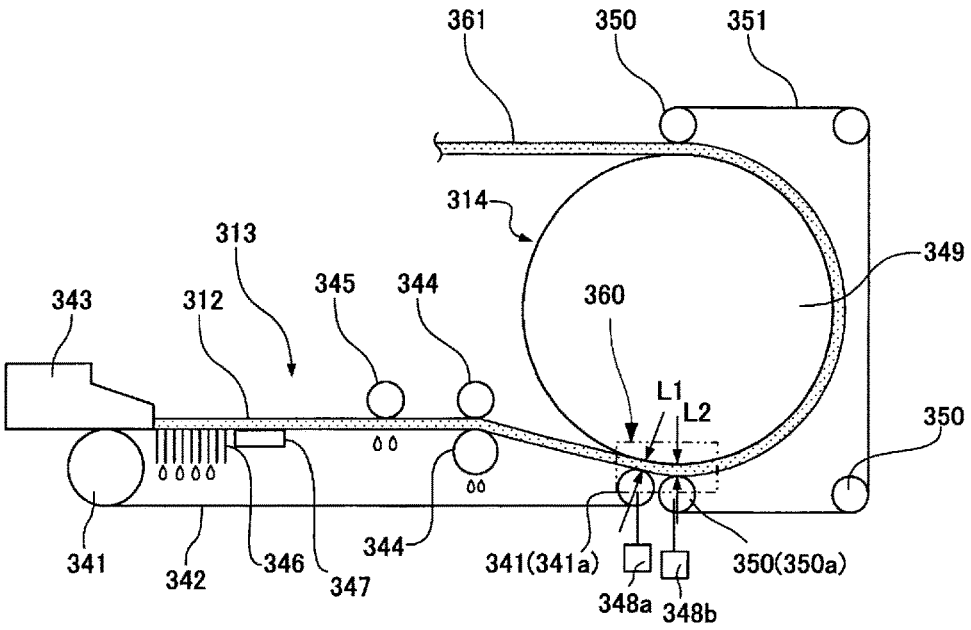
FIG. 3 is a schematic diagram illustrating a major portion of a waste paper recycling apparatus in still another embodiment of the present invention.

As illustrated in FIG. 3, the wet paper 312 is transferred from the papermaking wire 342 to the drying roller 349 in the press area 360. In the press area 360, the particular supporting roller 341*a* as one of the supporting rollers 341 supporting the papermaking wire 342 and the particular supporting roller 350*a* as one of the supporting rollers 350 supporting the canvas belt 351 are disposed close to each other. These two supporting rollers 341*a* and 350*a* are disposed positions facing the drying roller 349.

Further, the particular supporting roller 341*a* of the papermaking wire 342 is coupled to a first roller position regulator 348*a*. The particular supporting roller 350*a* of the canvas belt 351 located downstream in the conveying direction is coupled to a second roller position regulator 348*b*.

Then, in the press area 360, at a position corresponding to the particular supporting roller 341*a* of the papermaking wire 342, a gap between the conveying surface of the papermaking wire 342 and the heating surface of the drying roller 349, facing each other across the wet paper 312, provided as the pressure regulating gap L1.

In addition, at a position corresponding to the particular supporting roller 350*a* of the canvas belt 351, a gap between the conveying surface of the canvas belt 351 and the heating surface of the drying roller 349 is provided as a pressure regulating gap L2.

The position of the particular supporting roller 341*a* is regulated by the first roller position regulator 348*a* and the position of the particular supporting roller 350*a* is regulated by the second roller position regulator 348*b* to set the pressure regulating gap L1 to be greater than the pressure regulating gap L2.

By such setting, the gap between the conveying surface and the heating surface is decreased to the pressure regulating gap L1 and then further stepwise decreased to the pressure regulating gap L2, thereby increasing the pressure applied in the press area 360 stepwise to the target pressure.

As a result, in an early stage of the drying, the wet paper 312 is pressed against the heating surface of the drying roller 349 at the target pressure, that is, a pressure that does not excessively compress the fibrous layer of the wet paper 312, thereby preventing burning of the wet paper 312 on the heating surface.

Fourth Embodiment

Figure 4:
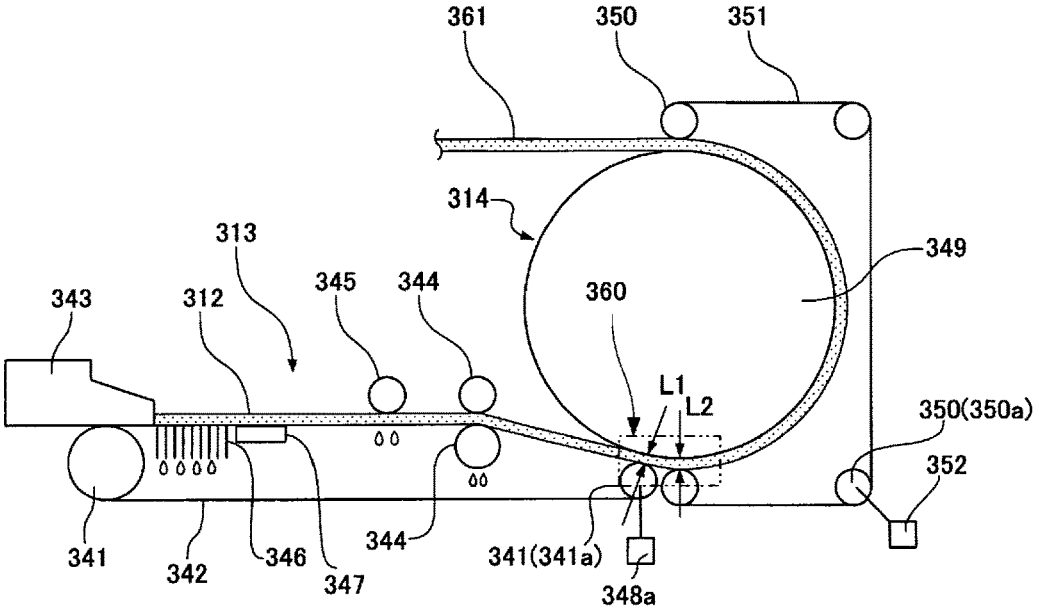
FIG. 4 is a schematic diagram illustrating a major portion of a waste paper recycling apparatus in still another embodiment of the present invention.

FIG. 4 illustrates a substitution for the second roller position regulator 348*b* in the third embodiment. In this example, one of the supporting rollers 350 supporting the canvas belt 351 is coupled to the tension regulator 352 to regulate the tension of the canvas belt 351 as a pressure regulator. The tension regulator 352 regulates the tension of the canvas belt 351 to regulate an increase or a decrease of the pressure regulating gap L2.

Fifth Embodiment

Figure 5:
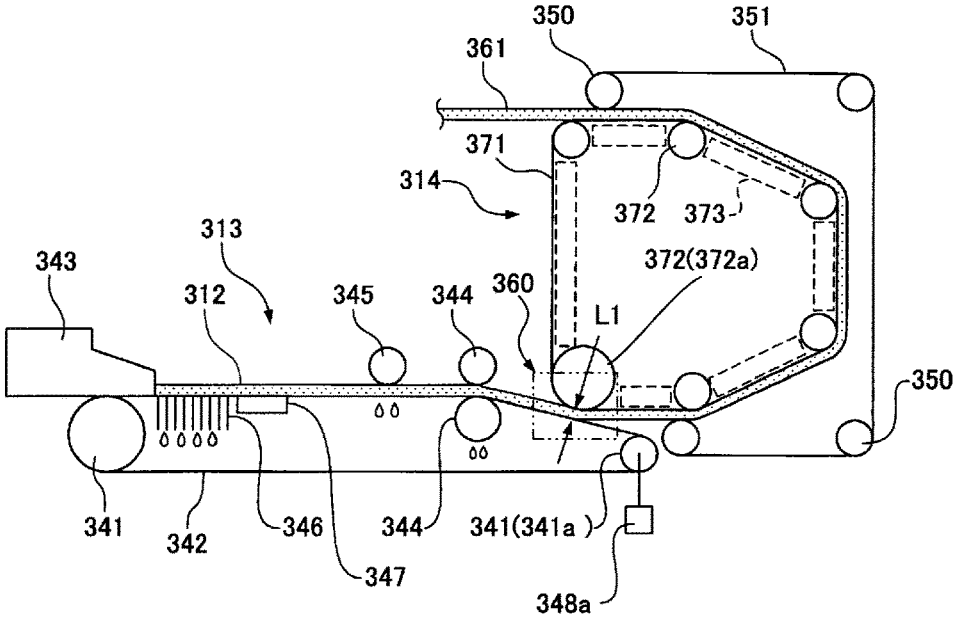
FIG. 5 is a schematic diagram illustrating a major portion of a waste paper recycling apparatus in still another embodiment of the present invention.

As illustrated in FIG. 5, in the drier 314, the drying rotary element may be configured by stretching a steel belt 371 over a plurality of supporting rollers 372 in an endless path. The steel belt 371 is arranged with heating devices 373 on the back side opposed to the heating surface. The heating devices 373 heat the entire circumference of the steel belt 371 except for the supporting rollers 372. In the press area 360, the wet paper 312 is then transferred to the steel belt 371.

In this example, the press area 360 is in the following configuration. That is, between the pressing rollers 344 and the particular supporting roller 341*a* supporting the papermaking wire 342 downstream therefrom, a particular supporting roller 372*a* as one of the supporting rollers 372 supporting the steel belt 371 is disposed at a position facing the papermaking wire 342.

Instead of the above configuration, a pair of particular supporting rollers 341*a* may be disposed downstream from the pressing rollers 344 to have the particular supporting rollers 372*a* of the steel belt 371 facing the papermaking wire 342 between the particular supporting rollers 341*a*.

Then, in the press area 360, at a position corresponding to the particular supporting roller 372*a* of the steel belt 371, a gap between the conveying surface of the papermaking wire 342 and a heating surface of the steel belt 371 across the wet paper 312 is provided as the pressure regulating gap L1.

Further, the particular supporting roller 341*a* of the papermaking wire 342 is coupled to the roller position regulator 348*a* as the pressure regulator.

In this case, the position of the particular supporting roller 341*a* is regulated by the roller position regulator 348*a* to increase or decrease the pressure regulating gap L1, thereby bringing the pressure to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

Sixth Embodiment

Figure 6:
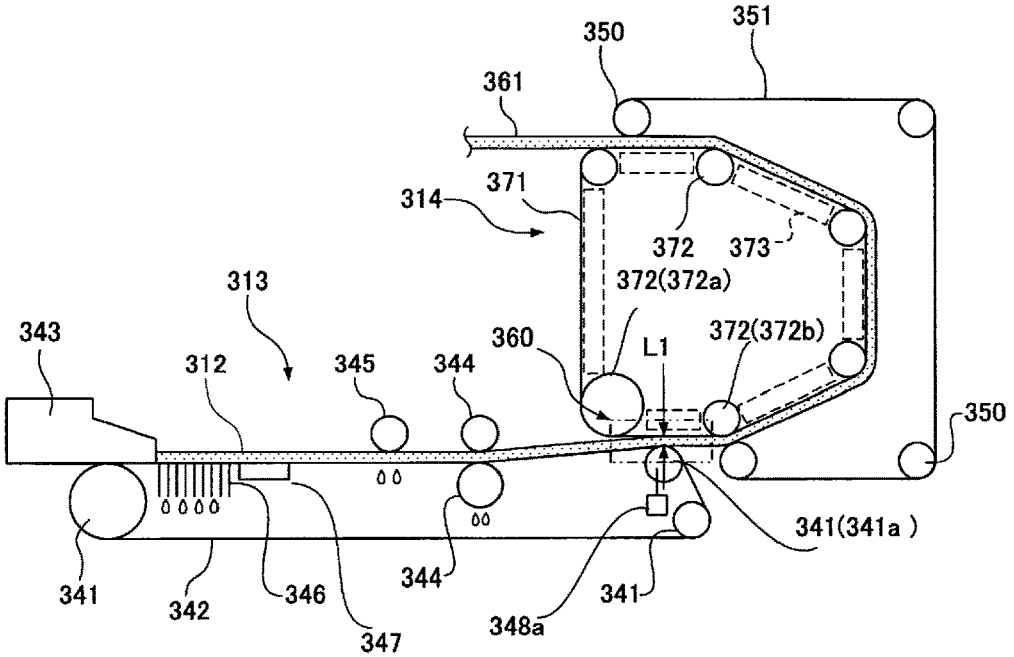
FIG. 6 is a schematic diagram illustrating a major portion of a waste paper recycling apparatus in still another embodiment of the present invention.

As illustrated in FIG. 6, between particular supporting rollers 372*a* and 372*b* among the supporting rollers 372 supporting the steel belt 371, the wet paper 312 is transferred from the papermaking wire 342 to the steel belt 371 in the press area 360. In the press area 360, the particular supporting roller 341*a* as one of the supporting rollers 341 supporting the papermaking wire 342 is disposed at a position facing the steel belt 371 between the particular supporting rollers 372*a* and 372*b* among the supporting rollers 372 supporting the steel belt 371.

At a position of the particular supporting roller 341*a* of the papermaking wire 342, a gap between the conveying surface of the papermaking wire 342 and the heating surface of the steel belt 371, facing each other across the wet paper 312, is provided as the pressure regulating gap L1.

Further, the particular supporting roller 341*a* of the papermaking wire 342 is coupled to the roller position regulator 348*a* as the pressure regulator.

In this case, the position of the particular supporting roller 341*a* is regulated by the roller position regulator 348*a* to increase or decrease the pressure regulating gap L1, thereby bringing the pressure to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

Seventh Embodiment

Figure 7:
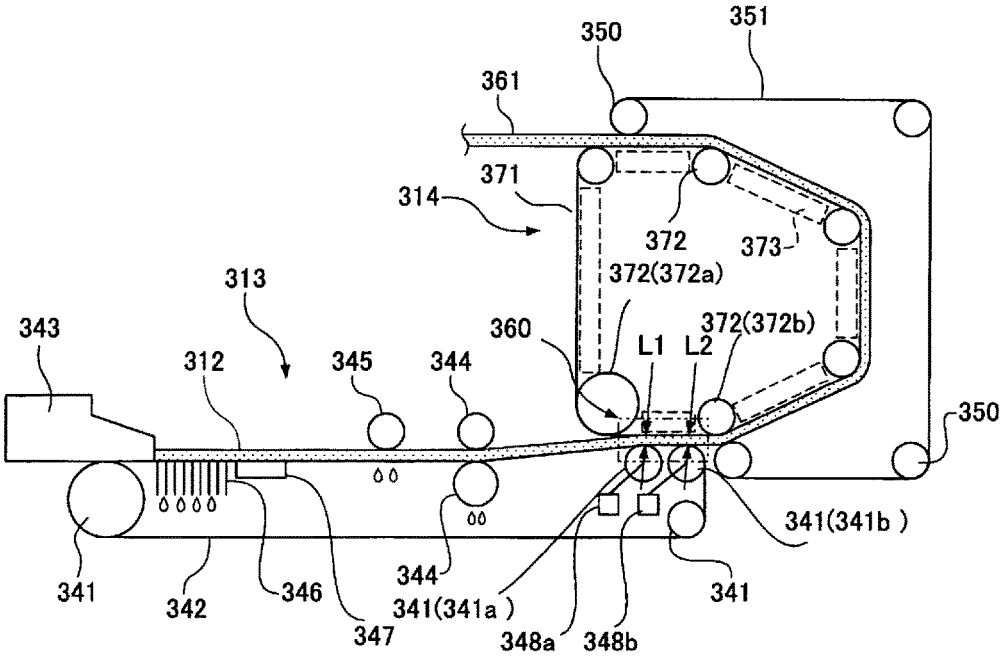
FIG. 7 is a schematic diagram illustrating a major portion of a waste paper recycling apparatus in still another embodiment of the present invention.

As illustrated in FIG. 7, the wet paper 312 is transferred from the papermaking wire 342 to the steel belt 371 in the press area 360. In the press area 360, between the pair of particular supporting rollers 372*a* and 372*b* among the supporting rollers 372 supporting the steel belt 371, a pair of particular supporting rollers 341*a* and 341*b* among the supporting rollers 341 supporting the papermaking wire 342 are disposed at a position facing the steel belt 371.

Further, the first particular supporting roller 341*a* is coupled to the first roller position regulator 348*a*. The second particular supporting roller 341*b* located downstream in the conveying direction is coupled to the second roller position regulator 348*b*.

Then, at positions corresponding to the first and second particular supporting rollers 341*a* and 341*b*, gaps between the conveying surface of the papermaking wire 342 and the heating surface of the steel belt 371, facing each other across the wet paper 312, are provided respectively as the pressure regulating gaps L1 and L2.

In this case, the position of the first particular supporting roller 341*a* is regulated by the first roller position regulator 348*a* and the position of the second particular supporting roller 341*b* is regulated by the second roller position regulator 348*b* to increase or decrease the pressure regulating gap L1 to set the pressure regulating gap L1 to be greater than the pressure regulating gap L2.

By such setting, the gap between the conveying surface and the heating surface is decreased to the pressure regulating gap L1 and then further stepwise decreased to the pressure regulating gap L2, thereby increasing the pressure stepwise to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

Eighth Embodiment

Figure 8:
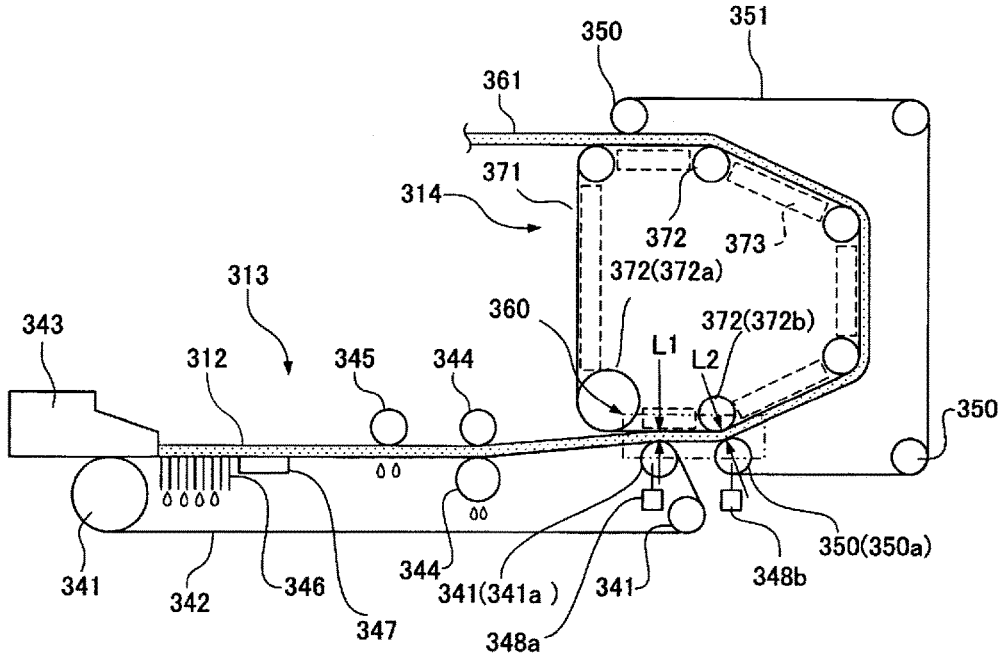
FIG. 8 is a schematic diagram illustrating a major portion of a waste paper recycling apparatus in still another embodiment of the present invention.

As illustrated in FIG. 8, the wet paper 312 is transferred from the papermaking wire 342 to the steel belt 371 in the press area 360. In the press area 360, between the pair of particular supporting rollers 372*a* and 372*b* among the supporting rollers 372 supporting the steel belt 371, the one particular supporting roller 341*a* among the supporting rollers 341 supporting the papermaking wire 342 is disposed at a position facing the steel belt 371.

In addition, at a position facing the particular supporting roller 372*b* downstream of the steel belt 371, the one particular supporting roller 350*a* among the supporting rollers 350 supporting the canvas belt 351 is disposed.

Further, the particular supporting roller 341*a* of the papermaking wire 342 is coupled to the first roller position regulator 348*a*, and the particular supporting roller 350*a* of the canvas belt 351 is coupled to the second roller position regulator 348*b*.

Then, at positions corresponding to the particular supporting roller 341*a* of the papermaking wire 342 and the particular supporting roller 350*a* of the canvas belt 351, a gap between the conveying surface of the papermaking wire 342 and the heating surface of the steel belt 371, facing each other across the wet paper 312, and a gap between the conveying surface of the canvas belt 351 and the heating surface of the steel belt 371 are provided respectively as the pressure regulating gaps L1 and L2.

In this case, the position of the particular supporting roller 341*a* of the papermaking wire 342 is regulated by the first roller position regulator 348*a* and the position of the particular supporting roller 350*a* of the canvas belt 351 is regulated by the second roller position regulator 348*b* to set the pressure regulating gap L1 to be greater than the pressure regulating gap L2.

By such setting, the gap between the conveying surface and the heating surface is decreased to the pressure regulating gap L1 and then further stepwise decreased to the pressure regulating gap L2, thereby increasing the pressure stepwise to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

Ninth Embodiment

Figure 9:
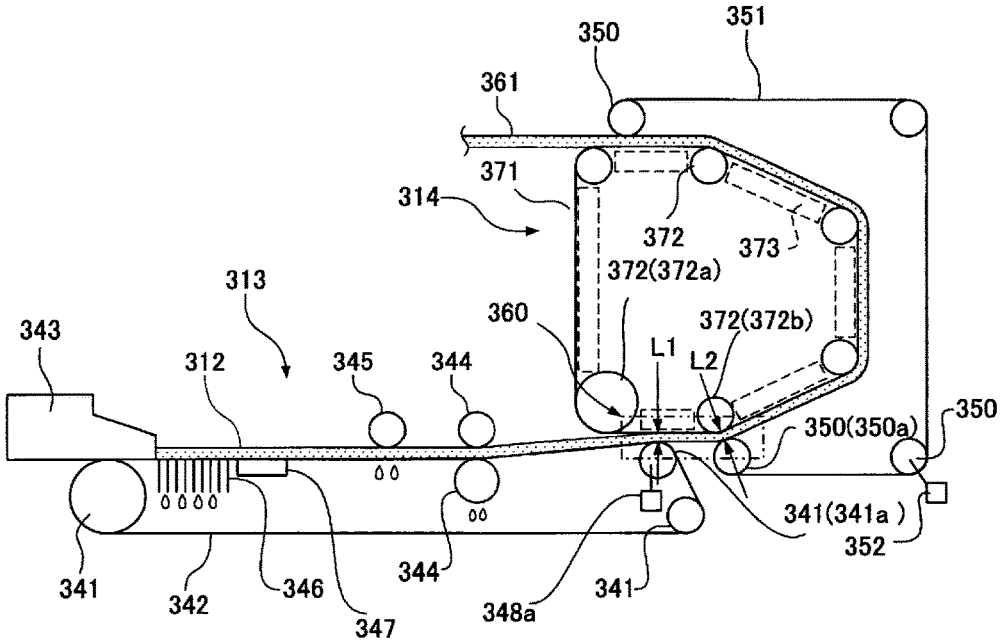
FIG. 9 is a schematic diagram illustrating a major portion of a waste paper recycling apparatus in still another embodiment of the present invention.

FIG. 9 illustrates a substitution for the second roller position regulator 348*b* in the eighth embodiment. In this example, one of the supporting rollers 350 of the canvas belt 351 is coupled to the tension regulator 352 to regulate the tension of the canvas belt 351 as the pressure regulator.

The position of the particular supporting roller 341*a* of the papermaking wire 342 is then regulated by the first roller position regulator 348*a* and the tension of the canvas belt 351 is regulated by the tension regulator 352, thereby setting the pressure regulating gap L1 to be greater than the pressure regulating gap L2.

By such setting, the gap between the conveying surface and the heating surface is decreased to the pressure regulating gap L1 and then further stepwise decreased to the pressure regulating gap L2, thereby increasing the pressure stepwise to the target pressure.

Tenth Embodiment

Figure 10:
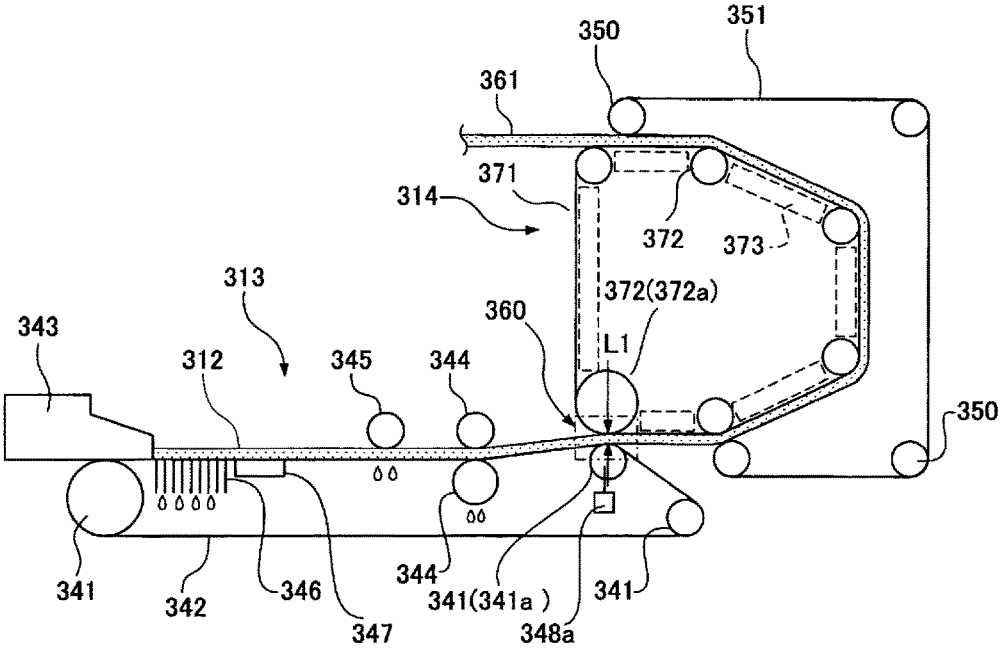
FIG. 10 is a schematic diagram illustrating a major portion of a waste paper recycling apparatus in still another embodiment of the present invention.

As illustrated in FIG. 10, the wet paper 312 is transferred from the papermaking wire 342 to the steel belt 371 in the press area 360. In the press area 360, the one particular supporting roller 372*a* among the supporting rollers 372 supporting the steel belt 371 faces the one particular supporting roller 341*a* among the supporting rollers 341 supporting the papermaking wire 342.

At a position of the particular supporting roller 341*a* of the papermaking wire 342, a gap between the conveying surface of the papermaking wire 342 and the heating surface of the steel belt 371, facing each other across the wet paper 312, is provided as the pressure regulating gap L1.

The particular supporting roller 341*a* of the papermaking wire 342 is then coupled to the roller position regulator 348*a* as the pressure regulator.

In this case, the position of the particular supporting roller 341*a* is regulated by the roller position regulator 348*a* to increase or decrease the pressure regulating gap L1, thereby bringing the pressure to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

Eleventh Embodiment

Figure 11:
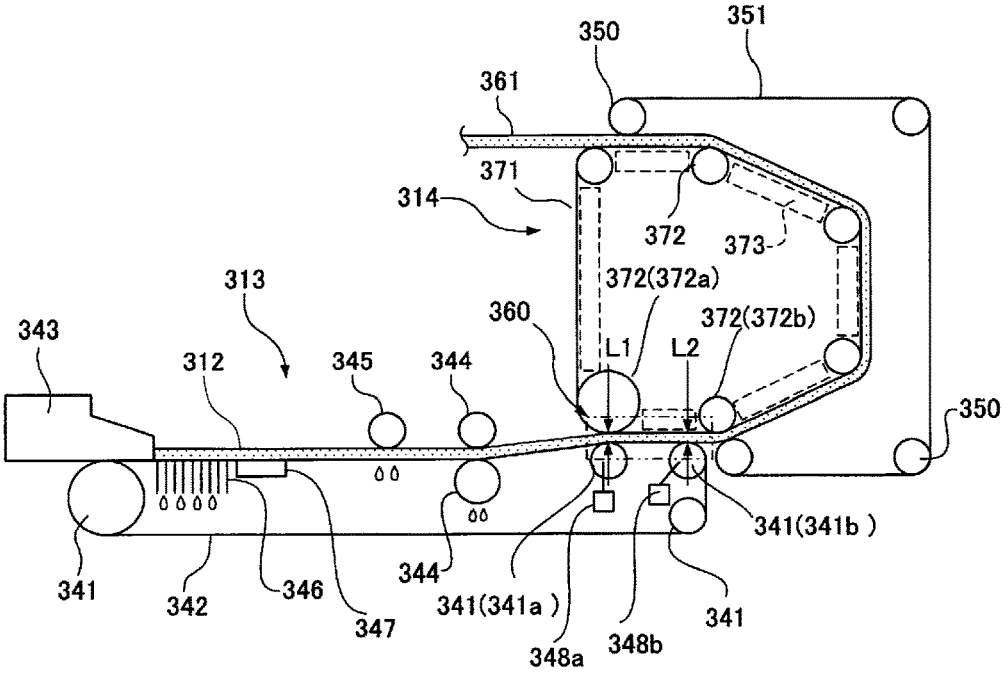
FIG. 11 is a schematic diagram illustrating a major portion of a waste paper recycling apparatus in still another embodiment of the present invention.

As illustrated in FIG. 11, the wet paper 312 is transferred from the papermaking wire 342 to the steel belt 371 in the press area 360. In the press area 360, the one particular supporting roller 372*a* among the supporting rollers 372 supporting the steel belt 371 faces the first particular supporting roller 341*a* among the supporting rollers 341 supporting the papermaking wire 342. Further, at a position facing the steel belt 371 downstream from the first particular supporting roller 341*a* in the conveying direction, the second particular supporting roller 341*b* is disposed.

The first particular supporting roller 341*a* is coupled to the first roller position regulator 348*a* as the pressure regulator, and the second particular supporting roller 341*b* is coupled to the second roller position regulator 348*b* as the pressure regulator.

Then, at positions corresponding to the first and second particular supporting rollers 341*a* and 341*b* of the papermaking wire 342, gaps between the conveying surface of the papermaking wire 342 and the heating surface of the steel belt 371, facing each other across the wet paper 312, are provided respectively as the pressure regulating gaps L1 and L2.

In this case, the position of the first particular supporting roller 341*a* of the papermaking wire 342 is regulated by the first roller position regulator 348*a* and the position of the second particular supporting roller 341*b* is regulated by the second roller position regulator 348*b* to set the pressure regulating gap L1 to be greater than the pressure regulating gap L2.

By such setting, the gap between the conveying surface and the heating surface is decreased to the pressure regulating gap L1 and then further stepwise decreased to the pressure regulating gap L2, thereby increasing the pressure stepwise to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

Twelfth Embodiment

Figure 12:
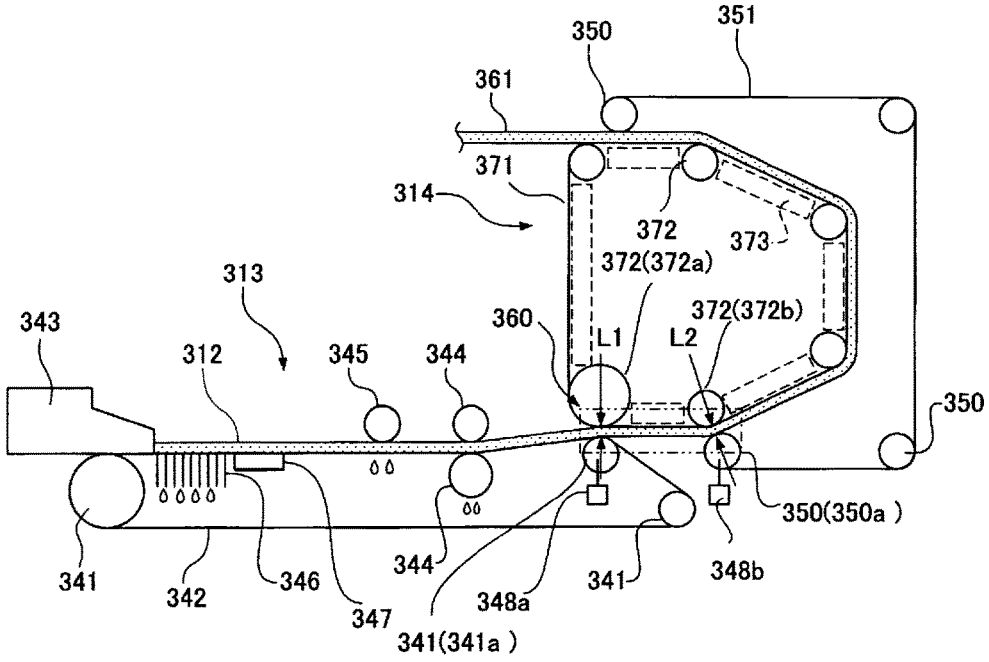
FIG. 12 is a schematic diagram illustrating a major portion of a waste paper recycling apparatus in still another embodiment of the present invention.

As illustrated in FIG. 12, the wet paper 312 is transferred from the papermaking wire 342 to the steel belt 371 in the press area 360. In the press area 360, the first particular supporting roller 372*a* among the supporting rollers 372 supporting the steel belt 371 faces the one particular supporting roller 341*a* among the supporting rollers 341 supporting the papermaking wire 342.

In addition, at a position facing the second particular supporting roller 372*b* located downstream from the first particular supporting roller 372*a* of the steel belt 371, the one particular supporting roller 350*a* among the supporting rollers 350 supporting the canvas belt 351 is disposed.

Further, the particular supporting roller 341*a* of the papermaking wire 342 is coupled to the first roller position regulator 348*a*, and the particular supporting roller 350*a* of the canvas belt 351 is coupled to the second roller position regulator 348*b*.

Then, at positions corresponding to the particular supporting roller 341*a* of the papermaking wire 342 and the particular supporting roller 350*a* of the canvas belt 351, a gap between the conveying surface of the papermaking wire 342 and the heating surface of the steel belt 371, facing each other across the wet paper 312, and a gap between the conveying surface of the canvas belt 351 and the heating surface of the steel belt 371, facing each other across the wet paper 312, are provided respectively as the pressure regulating gaps L1 and L2.

In this case, the position of the particular supporting roller 341*a* of the papermaking wire 342 is regulated by the first roller position regulator 348*a* and the position of the particular supporting roller 350*a* is regulated by the second roller position regulator 348*b* to set the pressure regulating gap L1 to be greater than the pressure regulating gap L2.

By such setting, the gap between the conveying surface and the heating surface is decreased to the pressure regulating gap L1 and then further stepwise decreased to the pressure regulating gap L2, thereby increasing the pressure stepwise to the target pressure.

As a result, in an early stage of the drying, the wet paper 312 is pressed against the heating surface of the steel belt 371 at the target pressure that does not excessively compress the fibrous layer of the wet paper 312, thereby preventing burning of the wet paper 312 on the heating surface.

In the first to twelfth Embodiments above, the configuration has been described in which the conveyor includes the first conveying rotary element and the second conveying rotary element. The conveyor may be, however, configured with one conveying rotary element. In this case of the configuration, the papermaking wire 342 to be the first conveying rotary element also works as the canvas belt 351 to be the second conveying rotary element. Then, the papermaking wire 342 in the outward portion goes through the respective parts in order of the head box 343, the drainer 346, the suction device 347, the dewatering roller 345, the pressing rollers 344, and the press area 360, and further through the drying roller 349 or the steel belt 371 to convey a wet paper.

What is claimed is:

1. A method of drying a wet paper, comprising:

moving a heating surface to heat the wet paper with a drying setting temperature for the wet paper in a conveying direction of the wet paper, pressing the wet paper against the heating surface in a press area by a conveying surface to convey the wet paper; and drying the wet paper on the heating surface to make recycled paper, wherein a pressure regulating gap, formed in the press area, between the heating surface and the conveying surface is provided in a size less than a thickness of the wet paper and more than a thickness of the recycled paper, thereby regulating a pressure applied in the press area to a target pressure to obtain dry paper without burning on the heating surface.

2. A waste paper recycling apparatus, comprising:

a conveyor to convey a wet paper, the conveyor having a conveying surface to convey the wet paper, a drier to dry the wet paper on a heating surface with a drying setting temperature for the wet paper, the heating surface moving in a conveying direction of the wet paper, a press area to press the wet paper against the heating surface by the conveying surface; and a pressure regulator to regulate a pressure applied in the press area, wherein the press area has a pressure regulating gap between the heating surface and the conveying surface, and the pressure regulator regulates the pressure applied in the press area to a target pressure by providing the pressure regulating gap in a size less than a thickness of the wet paper and more than a thickness of recycled paper.

3. The waste paper recycling apparatus according to claim 2, further comprising a press dewatering unit to press dewater the wet paper upstream from the press area in the conveying direction.

4. The waste paper recycling apparatus according to claim 2, wherein the drier has: one drying rotary element with an outer peripheral surface as the heating surface; and a heating device to warm the heating surface to a drying setting temperature for the wet paper, and the conveyor includes: a first conveying rotary element with a first outer peripheral surface as a part of the conveying surface, the first conveying rotary element disposed to be stretched over a plurality of supporting rollers in an endless path; and a second conveying rotary element with a second outer peripheral surface as another part of the conveying surface, the second conveying rotary element disposed around the heating surface of the drying rotary element to be stretched over a plurality of supporting rollers and the drying rotary element in an endless path.

5. The waste paper recycling apparatus according to claim 2, wherein the drier has: a drying rotary element with an outer peripheral surface as the heating surface, the drying rotary element disposed to be stretched over a plurality of supporting rollers in an endless path; and a heating device to warm the heating surface to a drying setting temperature for the wet paper, and the conveyor includes: a first conveying rotary element with a first outer peripheral surface as a part of the conveying surface, the first conveying rotary element disposed to be stretched over a plurality of supporting rollers in an endless path; and a second conveying rotary element with a second outer peripheral surface as another part of the conveying surface, the second conveying rotary element disposed around the heating surface of the drying rotary element to be stretched over a plurality of supporting rollers and the drying rotary element in an endless path.

6. The waste paper recycling apparatus according to claim 4, wherein the pressure regulator includes a tension regulator to regulate tension of the second conveying rotary element, the tension regulator regulating the tension to increase or decrease the pressure regulating gap, thereby bringing the pressure applied in the press area to the target pressure.

7. The waste paper recycling apparatus according to claim 4, wherein the pressure regulator includes a roller position regulator to regulate a position of a particular supporting roller of the first conveying rotary element, the roller position regulator regulating the position of the particular supporting roller to increase or decrease the pressure regulating gap, thereby bringing the pressure applied in the press area to the target pressure.

8. The waste paper recycling apparatus according to claim 4, wherein the pressure regulator includes a roller position regulator to regulate a position of a particular supporting roller of the second conveying rotary element, the roller position regulator regulating the position of the particular supporting roller to increase or decrease the pressure regulating gap, thereby bringing the pressure applied in the press area to the target pressure.

9. The waste paper recycling apparatus according to claim 5, wherein the pressure regulator includes a tension regulator to regulate tension of the second conveying rotary element, the tension regulator regulating the tension to increase or decrease the pressure regulating gap, thereby bringing the pressure applied in the press area to the target pressure.

10. The waste paper recycling apparatus according to claim 5, wherein the pressure regulator includes a roller position regulator to regulate a position of a particular supporting roller of the first conveying rotary element, the roller position regulator regulating the position of the particular supporting roller to increase or decrease the pressure regulating gap, thereby bringing the pressure applied in the press area to the target pressure.

11. The waste paper recycling apparatus according to claim 5, wherein the pressure regulator includes a roller position regulator to regulate a position of a particular supporting roller of the second conveying rotary element, the roller position regulator regulating the position of the particular supporting roller to increase or decrease the pressure regulating gap, thereby bringing the pressure applied in the press area to the target pressure.

* * * * *